United States Patent [19]

Mayer et al.

[11] Patent Number: 4,968,858

[45] Date of Patent: Nov. 6, 1990

[54] DISTRIBUTOR FOR AN IGNITION SYSTEM OF AN INTERNAL COMBUSTION ENGINE

[75] Inventors: Artur Mayer; Hans Neu, both of Vaihingen/Enz; Dieter Raff; Dieter Reinmueller, both of Schwieberdingen; Richard Gerber, Stuttgart; Ulrich Brintzinger, Gerlingen; Juergen Schmatz, Mundelsheim; Karl Ehrmann, Stuttgart, all of Fed. Rep. of Germany

[73] Assignee: Robert Bosch GmbH, Stuttgart, Fed. Rep. of Germany

[21] Appl. No.: 428,185

[22] Filed: Oct. 27, 1989

[30] Foreign Application Priority Data

Nov. 8, 1988 [DE] Fed. Rep. of Germany ..... 3837808

[51] Int. Cl.[5] ..... H01H 19/00; F02P 7/00

[52] U.S. Cl. ..... 200/19 R; 200/19 DC; 200/19 DR

[58] Field of Search ..... 200/19 R, 19 DC, 19 DR, 200/20, 21

[56] References Cited

U.S. PATENT DOCUMENTS

| | | | |
|---|---|---|---|
| 4,304,972 | 12/1981 | Fox et al. | 200/19 DC X |
| 4,338,895 | 7/1982 | Lennis et al. | 200/19 DC X |
| 4,631,371 | 12/1986 | Kronberger | 200/19 DC |
| 4,764,646 | 8/1988 | Hanning et al. | 200/19 DC |

*Primary Examiner*—J. R. Scott

*Attorney, Agent, or Firm*—Michael J. Striker

[57] ABSTRACT

The distributor has a distributor rotor with a radially extending rotor electrode attached nonrotably to a drive shaft, a distributor cap provided with a number of connectors on top each having a through-going opening in an interior wall of the cap, a center electrode insertable through the center connector in the cap and distributor electrodes insertable through peripherally disposed connectors so that they are positionable spaced from the rotor electrode during rotation of the distributor rotor past them, connecting cables each of which are connected to an electrode for conveying ignition energy to a spark plug and retaining members each releasably holding one of the distributor electrodes in place in the cap. The free end of one of the electrodes may be serrated or knurled while its other end together with the connected end of the connecting cable is enclosed by a lip member made of an elastic insulating material, in which one of the connectors is insertable and tightly held.

20 Claims, 2 Drawing Sheets

DISTRIBUTOR FOR AN IGNITION SYSTEM OF AN INTERNAL COMBUSTION ENGINE

BACKGROUND OF THE INVENTION

Our invention relates to an ignition system and, more particularly, to a distributor for a distributor of an internal combustion engine.

A distributor which is a part of an ignition system of an internal combustion engine is known. This distributor functions to deliver ignition energy to spark plugs of the engine in the proper sequence. The distributor which is connected electrically to the spark plugs comprises a drive shaft, a distributor rotor having a rotor axis and a radially extending rotor electrode, this distributor rotor being nonrotatably mounted on the drive shaft, a distributor cap made of insulating material having an interior wall and being provided with a plurality of through-going openings, connecting cables each of which are connected electrically to one of the spark plugs over which ignition energy is conducted, a center electrode provided in the distributor cap, a plurality of distributor electrodes each mounted in one of the through-going openings and connected to one of the connecting cables by or past which the rotor electrode is moved so that ignition energy is conductable to each of the distributor electrode from the center electrode via the rotor electrode as it rotates.

In these known distributors the electrodes, i.e. the center electrode and the distributor electrodes are enclosed by the distributor cap made of insulating material and are nonreleasably mounted in the cap. The contact of the electrodes with the connecting cable occurs by a plug socket connection. These plug connections are formed to be detachable or releasable and are a source of trouble. Among other things with a plug connection the electrical connection between the connecting cable and the electrodes may be incomplete or loosened to the point where the connection is broken. It may not be made at all for various reasons. An incomplete plug connection can under certain circumstances loosen during operation and lead to a power failure or damage to the internal combustion engine or ignition system.

SUMMARY OF THE INVENTION

Accordingly, it is an object of our invention to provide reliable releasable mounting or attachment means between the electrodes and the cap of a distributor and to improve the manufacture of the distributor.

It is also an object of our invention to make a simple cap with a low manufacturing expense by which a more reliable connection between the ignition energy source and the ignition sites to which ignition energy is to be distributed may be provided.

In keeping with these objects and with others which will become apparent hereinafter, a drive shaft, a distributor rotor having a rotor axis and radially extending rotor electrode, said distributor rotor being nonrotatably mounted on the drive shaft, a distributor cap made of insulating material having an interior wall and being provided with a plurality of through-going openings, a plurality of connecting cables connected electrically to the spark plugs over which ignition energy is conducted, a center electrode provided in the distributor cap, a plurality of distributor electrodes past which the rotor electrode is moved spaced therefrom, each of the distributor electrodes being insertable through one of the through-going openings in the cap and being connectable to one of the connecting cables, the ignition energy being conductable to the distributor electrode from the distributor rotor, and a plurality of retaining members releasably each holding one of the distributor electrodes in place in the distributor cap.

Since the electrodes are releasably mounted in the cap on one side but held reliably in place by the retaining members in it, a simple cap may be made by which a more reliable electrical connection is made. That the energy conduction between the center electrode and the distributor electrodes occurs without contact by sparkover is an additional advantage. Thus all electrical terminal connections which are possible sources of failure can be avoided. Also all electrodes are formed substantially equal which reduces the manufacturing costs.

There are several advantageous embodiments of our invention. The center electrode can also be inserted through one of the through-going holes in the cap and is held releasably in position in the cap by another retaining member and the center electrode projects into the cap adjacent the first free end of the rotor electrode which is pointed toward the rotation axis of the distributor rotor.

Advantageously the other retaining member comprises an automatically locking holder sleeve, which supports itself on the center electrode and the interior wall of the cap. This retaining member can comprise an automatically locking holder sleeve, which supports itself on the distributor electrode and the interior wall of the cap. The ignition energy conduction between the distributor electrodes and the rotor electrode distributor cap can be improved. Each of the distributor and center electrodes can have a pin with an annular shoulder, on which the holder sleeve is supported and the holder sleeve can have a plurality of resilient arms extending from the holder sleeve and braced on the interior wall of the cap. The holder sleeve can be part of a plastic cover of each of the distributor and center electrodes. To avoid short circuits or leakage the distributor electrodes and the center electrode each have a free end and the free ends can be knurled or serrated.

Advantageously the distributor cap can further comprise a lip member made of elastic insulating material which is insertable in one of the connectors. The lip member encloses partially the resistor and the connecting cable and a plurality of connectors projecting exteriorly from the cap in the vicinity of each of the openings. The connector can advantageously have an inner wall forming a stepped passage inwardly constricted toward the through-going opening and the lip members fit the stepped passage. Advantageously the lip member has annular bulged portions, which deform in the stepped passage when the lip member is inserted therein. The lip member can have a socket sleeve in which the connector is plugged which helps retain the connection.

With the structure according to our invention large tolerances in the cap can be compensated for, since an optimum energy conduction with reduced difficulties can be obtained because of the materials used and also because of the air gap tolerances.

BRIEF DESCRIPTION OF THE DRAWING

The objects, features and advantages of our invention will be made more apparent from the following detailed description, reference being made to the accompanying drawing in which.

DETAILED DESCRIPTION OF THE INVENTION

Figure 1:
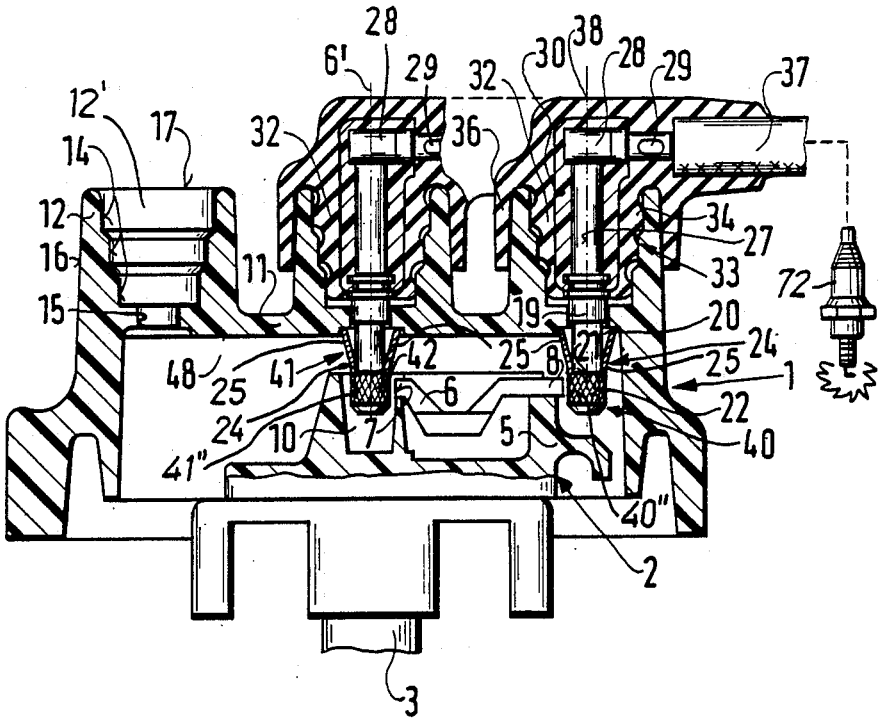
FIG. 1 is an axial cross sectional view of one embodiment of a distributor of an ignition system for an internal combustion engine according to our invention.

In FIG. 1 of the drawing the distributor cap 1 of a distributor according to our invention with its distributor rotor 2 is shown. This distributor rotor 2 is mounted on the end of a drive shaft 3 of the motor and is connected nonrotatably with it. It has a rotor finger 5, in which a rotor electrode 6 is inserted or embedded. The rotor electrode 6 extends in the radial direction along the rotor finger 8 and has a first free end 7 and a second free end 8. The first free end 7 projects into a central coaxial cavity 10 in the opposing face of the distributor rotor 2, while the second free end forms a part of a distributor circuit and performs the ignition energy distribution operation.

The distributor cap 1 mounted fixed in position on the distributor rotor 2 has a plurality of connectors 12, also called domes, on its facing side, which project parallel to the axis of the drive shaft or the rotor axis 6'. The connectors 12 have on their inside a stepped passage 14 with an inner wall 12' having a plurality of step diameters, which going from the interior to the outside. The stepped passage 14 continues in a through-going opening 15, which penetrates the top side 11 of the cap 1. The outer surfaces 16 of the connectors 12 are gently conically constricting toward or decreasing in diameter in the direction of the opening 17 of the connector. Also the interior portion containing the stepped passage can be gently conical or tapered also.

The connectors 12 receive the distributor electrodes 40 and a center electrode 41. The distributor electrodes 40 are arranged in a circle at the periphery of the distributor circuit and/or coaxial to the drive shaft, the rotor axis 6' and the central axis of the cap. Each electrode comprises a pin 19, which has an annular groove 20 which is bounded by an annular shoulder 21. The pin 19 is plugged in through the through-going opening 15 with play and forms with its inner end the actual electrode, to which the sparkover from the free end 8 of the rotor electrode 6 occurs in the case of a distributor electrode.

A holder sleeve 24 is snapped into the annular groove 20. Resilient arms 25 extend or spread from the holder sleeve 24. They support themselves with their ends on the inner side of the cap 1 and thus hold the pins 19 and/or the electrodes in the position shown in the drawing. The wall thickness of the holder sleeve 24 matches with the depth of the annular groove 20 so that the electrodes are inserted through the opening 15 with the resilient arms 25 pressed together. Subsequently the resilient arms spread themselves and lock the electrodes in the position shown.

The other end of each of the pins 19 is connected by an electrical resistor 27 and/or a resistor group with a connecting element 28, to which a connecting cable 29 is connectable. The resistor 27 may be a resistor suppressor. These parts are enclosed by lip members 32 made of elastic insulating material, which with their outer surfaces fit the shape of the stepped passage 14 in which the lip members are inserted. Especially the lip members 32 have annular bulged portions 34, which deform themselves on the corresponding inner surfaces of the stepped passage 14 in the connectors when the lip members 32 are plugged in so that a tight contact with the cap 1 is made. The lip members 32 have a connected socket sleeve 36, which in the plugged in state surrounds the connectors 12 tightly peripherally.

The connection of the connecting cable 29 with the connecting element 28 can be detachable or nondetachable as in the indicated embodiment. In this case a portion of the lip members 32 surrounds the cable and the end of the insulation 37 of the connecting cable, which extends at right angles to the common axis of the electrode 38 and/or the pin and the resistor.

In the embodiment shown in FIG. 1 three connectors 12 are drawn with two electrodes, which are formed identically. The distributor electrodes 40 are arranged in a circle on the distributor are positioned to form an air gap between themselves and the second free end of the rotor electrode. The distributor electrodes are knurled or serrated on their surface on the end associated with it, which improves the sparkover. Likewise center electrode 41 is partially inserted in the cavity 10, whose free end 42 forms an air gap with the first end 7 of the rotor electrode 6, which is jumped by the spark during the sparkover. The center and distributor electrodes 41, 40 have serrated ends 41'',40'' in the embodiment shown in FIG. 1 and have knurled ends 41',40' in the embodiment shown in FIG. 2. The pin 19 of the electrodes is made from brass and the rotor electrode can advantageously be made from calcium-silicon alloy.

Figure 2:
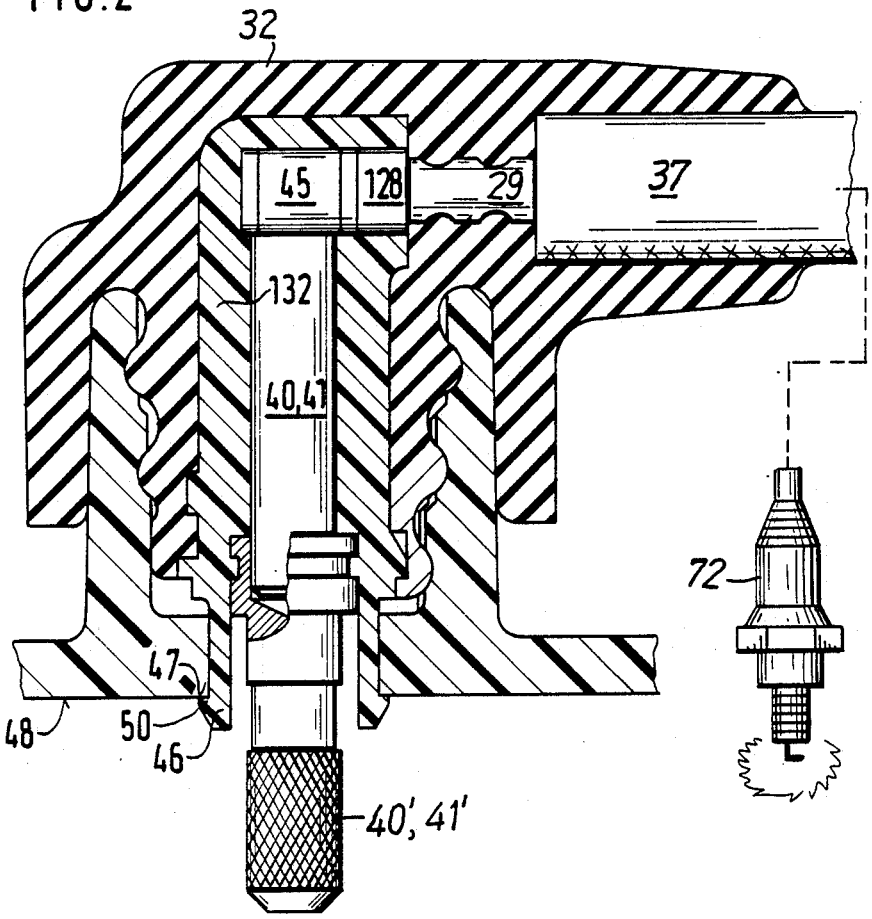
FIG. 2 is an axial cross sectional view of another embodiment of a distributor of an ignition system for an internal combustion engine according to our invention.

FIG. 2 shows another embodiment for attachment of the electrodes 40, 41 in the cap 1. In this example one or more locking arms 46 are formed on the facing side of the plastic cover 30 and/or 130 known from FIG. 1. These locking arms 46 project through the opening 15 and snap in the interior wall 48 with a nose 50 having locking surfaces 47 engaging on the interior wall 48 of the cap 1 on insertion of the electrode. Thus the electrode is held fixed in its plugged in position. The plastic cover 30 encloses as shown in FIG. 1 the electrodes 40 with the resistor 27 and the ends 45 of the electrically conducting connecting elements 128.

By definition "retaining member" comprise the holder sleeve 24 with the resilient arms 25 in the case of the first embodiment; the second embodiment the holder sleeve 24 also includes the locking arms 46 and locking surfaces 47. These retaining members act to hold the electrode in place when the cap is snapped in place.

It will be understood that each of the elements described above, or two or more together, may also find a useful application in other types of constructions differing from the types described above.

While the invention has been illustrated and described as embodied in a distributor for an ignition system of an internal combustion engine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of the prior art, fairly constitute essential characteristics of the generic or specific aspects of this invention.

What is claimed as new and desired to be protected by Letters Patent is set forth in the appended claims.

What is claimed is:

1. A distributor for an ignition system of an internal combustion engine with a drive shaft and connectable electrically to at least one spark plug comprising:

a distributor rotor having a rotor axis and a radially extending rotor electrode, said distributor rotor being nonrotatably mountable on a drive shaft, said rotor electrode having a first free end, a distributor cap made of insulating material having an interior wall and being provided with a plurality of through-going openings.

at least one connecting cable, each of said cables being connected electrically to one of said spark plugs, ignition energy being conducted over said cables from said rotor electrode, a center electrode provided in said distributor cap, a plurality of distributor electrodes past which said rotor electrode is moved spaced therefrom, each of said distributor electrodes being insertable through one of said through-going openings in said cap and being connectable electrically to one of said connecting cables, said ignition energy being conductable to said distributor electrode from said distributor rotor, and a plurality of retaining members releasably holding each of said distributor electrodes in place in said distributor cap.

2. A distributor according to claim 1, further comprising another retaining member releasably holding said center electrode in position in said distributor cap and wherein said center electrode has a free end projecting into said cap adjacent said first free end of said rotor electrode directed toward said rotor axis of said distributor rotor.

3. A distributor according to claim 2, wherein said other retaining member comprises an automatically locking holder sleeve, which supports itself on said center electrode and said interior wall of said cap.

4. A distributor according to claim 3, wherein said center electrode has a pin with an annular shoulder, on which said holder sleeve is supported and said holder sleeve has at least one resilient arm extending from said holder sleeve and braced on said interior wall of said distributor cap.

5. A distributor according to claim 3, further comprising a plastic cover and a connecting element enclosed by said plastic cover for said center electrode and a connecting element enclosed by said plastic cover and wherein said holder sleeve is part of said plastic cover of said center electrode, said center electrode associated with said connecting element also being at least partially enclosed by said plastic cover, said holder sleeve having at least one locking arm having a locking surface projecting through said through-going opening associated with said electrode, whose locking surface contacts on said interior wall of said cap when said electrode is inserted in said through-going opening.

6. A distributor according to claim 1, wherein said retaining member comprises an automatically locking holder sleeve, which supports itself on said distributor electrode and said interior wall of said cap.

7. A distributor according to claim 6, further comprising a plastic cover and a connecting element enclosed by said plastic cover for each of said distributor electrodes and wherein said holder sleeve is part of said plastic cover of each of said distributor electrodes, said distributor electrodes each associated with one of said connecting elements also being at least partially enclosed by said plastic cover, said holder sleeve having at least one locking arm having a locking surface projecting through said through-going opening associated with said distributor electrode, whose locking surface contacts on said interior wall of said cap when said electrode is inserted in said through-going opening.

8. A distributor according to claim 6, wherein each of said distributor electrodes has a pin with an annular shoulder, on which said holder sleeve is supported and said holder sleeve has at least one resilient arm extending from said holder sleeve and braced on said interior wall of said distributor cap.

9. A distributor according to claim 1, wherein said distributor electrodes and said center electrode each have a free end and said free ends are knurled.

10. A distributor according to claim 1, wherein said distributor electrodes and said center electrode each have a free end and said free ends are serrated.

11. A distributor according to claim 10, wherein said distributor cap has a plurality of connectors projecting exteriorly from said cap in the vicinity of each of said through-going openings and a plurality of lip members made of elastic insulating material in which each of said connectors are insertable, each of said lip members partially enclosing said resistor and said connecting cable.

12. A distributor according to claim 11, wherein each of said connectors has an inner wall forming a stepped passage inwardly constricted toward one of said through-going openings, each of said lip members fitting each of said stepped passages.

13. A distributor according to claim 12, wherein said lip member has a plurality of annular bulged portions, which deform in said stepped passage when said lip member is inserted therein.

14. A distributor according to claim 12, wherein each of said lip members has a socket sleeve which surrounds said connector peripherally when said connector is plugged in said socket sleeve.

15. A distributor according to claim 13, wherein each of said connecting cables is oriented at approximately right angles to said distributor electrodes and said center electrode.

16. A distributor according to claim 1, wherein each of said center and distributor electrodes comprises a pin and further comprising a resistor located between said connecting cable and said pin.

17. A distributor according to claim 1, wherein each of said center and distributor electrodes comprises a pin and further comprising a resistor suppressor located between said connecting cable and said pin.

18. A distributor according to claim 1, wherein said rotor electrode is made of an alloy of calcium and silicon.

19. A distributor connectable electrically to at least one spark plug comprising:

a drive shaft, a distributor rotor having a rotor axis and a radially extending rotor electrode, said distributor rotor being nonrotatably mounted on said drive shaft, said rotor electrode having a first free end, a distributor cap made of insulating material having an interior wall and being provided with a plurality of through-going openings, a plurality of distributor electrodes past which said rotor electrode is moved spaced therefrom, each of said distributor electrodes being insertable through one of said through-going openings in said cap, said ignition energy being conductable to said distributor electrode from said distribution rotor, and a plurality of retaining members, each of said retaining members releasably holding one of said distributor electrodes in place in said distributor cap, each of said retaining members comprising an automatically locking holder sleeve, which supports itself on said distributor electrode.

20. A distributor according to claim 19, wherein each of said distributor electrodes has a pin with an annular shoulder, on which said holder sleeve is supported and said holder sleeve has at least one resilient arm extending from said holder sleeve and braced on said interior wall of said distributor cap.

* * * * *